US006449780B1

(12) United States Patent
Merry

(10) Patent No.: US 6,449,780 B1
(45) Date of Patent: Sep. 17, 2002

(54) COMBINED ADULT AND CHILDREN'S TOILET SEAT ASSEMBLY

(75) Inventor: Thomas G. Merry, Gardnerville, NV (US)

(73) Assignee: Pottypal L.L.C., Minden, NV (US)

( * ) Notice: Subject to any disclaimer, the term of this patent is extended or adjusted under 35 U.S.C. 154(b) by 0 days.

(21) Appl. No.: 09/778,974

(22) Filed: Feb. 8, 2001

(51) Int. Cl.[7] ..... A47K 13/00
(52) U.S. Cl. ..... 4/239; 4/235
(58) Field of Search ..... 4/239, 240, 237, 4/235, 234, 236; D23/311

(56) References Cited

U.S. PATENT DOCUMENTS

| | | | |
|---|---|---|---|
| 2,221,991 | A | 11/1940 | Myers et al. |
| 3,609,775 | A | 10/1971 | Leiter et al. |
| 4,461,046 | A | 7/1984 | Adams |
| 4,516,279 | A | 5/1985 | Block |
| 5,182,818 | A | 2/1993 | Nawoj |
| 5,363,509 | A | 11/1994 | Evans |
| 5,384,917 | A | 1/1995 | Epling |
| 5,448,781 | A | 9/1995 | Miller |
| 5,685,023 | A | 11/1997 | Alston |
| D435,638 | S | 12/2000 | Merry et al. |

*Primary Examiner*—Gregory Huson
*Assistant Examiner*—Huyen Le
(74) *Attorney, Agent, or Firm*—Dorsey & Whitney L.L.P.; Robert B. Chickering

(57) ABSTRACT

A combined adult and children's toilet seat assembly (21) having a seat mounting structure (22), a toilet seat lid (51) and an adult toilet seat (31) pivotally mounted to the mounting structure (22) for pivotal movement about a first axis (28). A children's toilet seat (33) is pivotally mounted for movement about a second axis (44) forwardly of the first axis (28). Pivoting of the child's seat (33) from an axis forwardly of pivotal mounting of the lid (51) enables the child's seat (33) to be lifted to a position in which it is tilted rearwardly by a greater amount than the lid (51) so as to positively nest and be gravity biased into the lid (51). The child's toilet seat (33) is further releasably mounted to the assembly by resilient grippers (46).

19 Claims, 5 Drawing Sheets

COMBINED ADULT AND CHILDREN'S TOILET SEAT ASSEMBLY

TECHNICAL FIELD

The present invention relates, in general, to toilet seats, and more particularly, relates to combination adult and children's toilet seat assemblies.

BACKGROUND ART

Considerable effort has been directed toward the development of combination child's and adult's toilet seats. Such assemblies typically have the child's seat pivoted to the same mounting assembly as the adult seat so that the child's seat, with its smaller opening, can be pivoted down over and rest on the adult seat. Such assemblies also usually include a seat lid which can pivot down on top of both the adult and child seat. The child's seat must also be pivotable to a raised, near vertical position at which it nests with, and is often retained by, the raised seat lid.

While such combined seat assemblies are known in the patent literature, commercial acceptance of the same has not been wide spread. Assembly bulkiness, or difficulty in mounting to the toilet bowl, or difficulty in removing the child's seat assembly, or unsightliness have all contributed to lack of acceptability. Typical of the combined adult and children's seat assemblies of the prior art are the devices shown in the following U.S. Pat. Nos.: 5,685,023, 5,448,781, 5,384,917, 5,363,509, 5,182,818, 4,516,279, 4,461,046, 3,609,775 and 2,221,991.

Accordingly, it is an object of the present invention to provide a combined adult and children's toilet seat assembly in which the overall assembly is compact, aesthetically pleasing and functionally efficient.

Another object of the present invention is to provide a combined adult and children's toilet seat assembly in which the children's seat nests into the lid of the assembly in a very compact position and is highly stable in the raised position without the need for special detents or retainer devices.

A still further object of the present invention is to provide a combination adult and children's toilet seat assembly which may be easily mounted to the toilet bowl, can have the child's toilet seat mounted to or removed from the assembly without the use of tools, and is easy to clean.

The combination adult and children's toilet seat assembly of the present invention has other objects and features of advantage which will become apparent from, or are set forth in more detail in, the following description of the Best Mode of Carrying Out the Invention and the accompanying drawing.

DISCLOSURE OF INVENTION

The combined adult and children's toilet seat assembly of the present invention comprises, briefly, a seat mounting structure formed for mounting of the seat assembly to a toilet bowl; a toilet seat lid pivotally mounted for pivoting of the lid about a first axis between a near horizontal position over the bowl and a rearwardly tilted, stable, near vertical position; and a children's toilet seat pivotally mounted about a second axis forwardly of the first axis for movement of the children's toilet seat between a near horizontal position superimposed over the adult toilet seat and a near vertical position tilted rearwardly into the seat lid by an amount greater than the rearward tilt of the seat lid. The assembly includes an adult toilet seat, and preferably the children's toilet seat is releasably mounted to the adult toilet seat for pivotal movement by at least one, and preferably two, resiliently expandable gripper structures. Moreover, the adult toilet seat advantageously includes a plurality of upwardly extending, laterally-spaced flanges to which the child's seat is mounted and which also provides a barrier resisting liquid migration toward the rear of the assembly.

BEST MODE OF CARRYING OUT THE INVENTION

Figure 1:
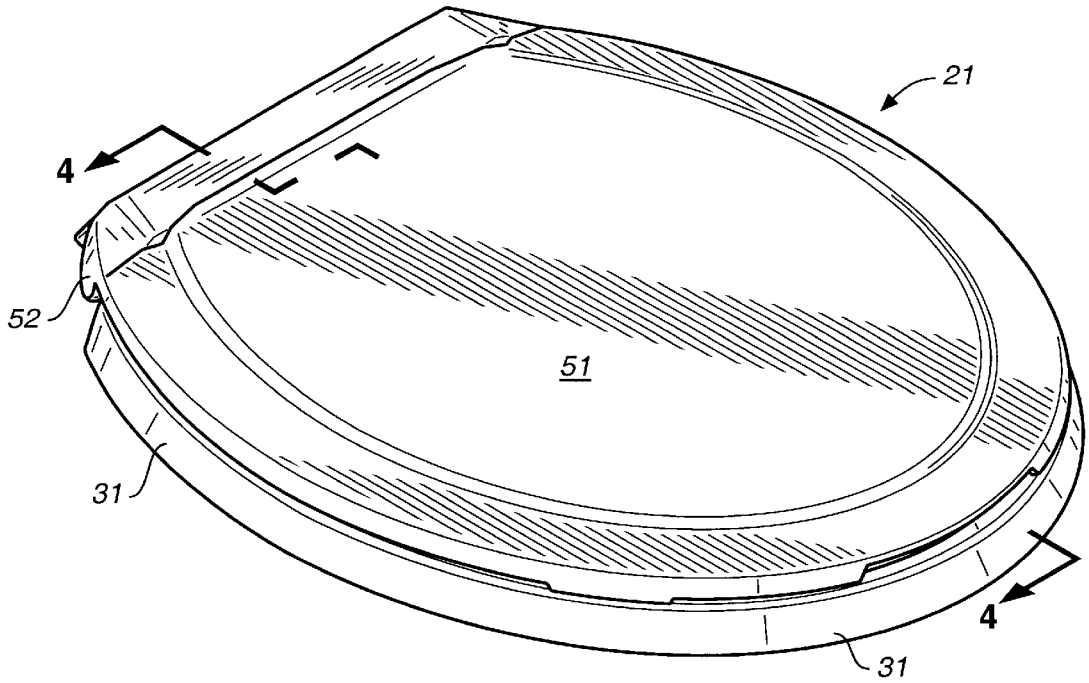
FIG. 1 is a top perspective view of a combined adult and children's toilet seat assembly constructed in accordance with the present invention, with all the components lowered or in a near horizontal position.

The combined adult and children's toilet seat assembly of the present invention is compact and has a visual appearance which is essentially identical to a conventional adult toilet seat assembly. Thus, as will be seen in the drawing, the combined adult and children's toilet seat assembly has a relatively thin vertical profile unlike many prior art assemblies. Thus, the child's seat is nested between the adult seat and the lid, and the child's seat does not add significantly to the overall height of the assembly.

Achieving this compact or low-profile structure, however, has not been accomplished in the present invention at the expense of the stability of components in various positions, nor through the use of clips or retainers of various kinds. Instead, the combined adult and children's toilet seat assembly of the present invention provides a pivotal mounting structure which is particularly effective in ensuring stability of the child's seat when it is raised for temporary storing inside the raised seat lid.

Figure 2:
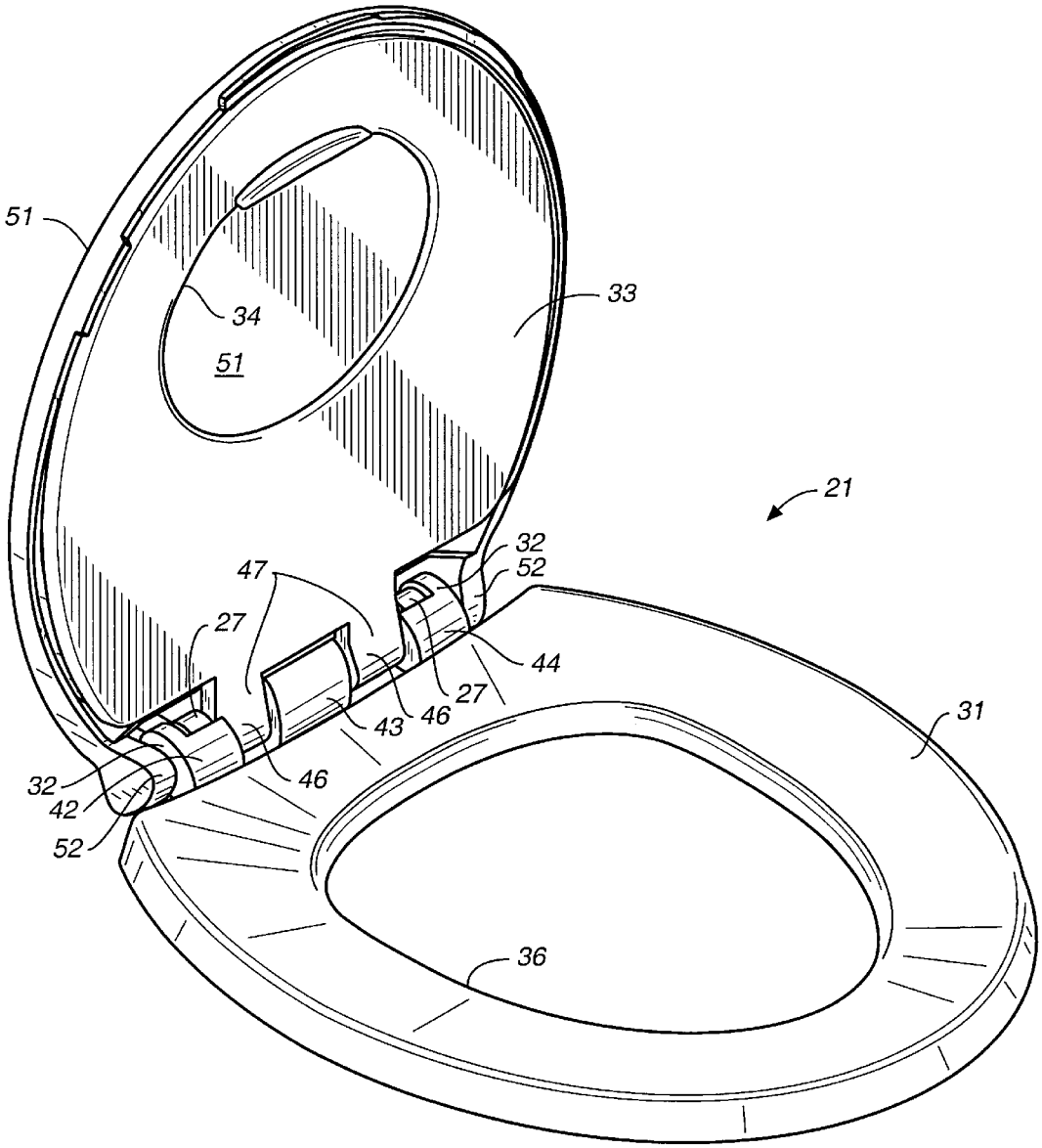
FIG. 2 is a top perspective view of the assembly of FIG. 1 with the lid and children's toilet seat in the raised or near vertical, but rearwardly tilted, position.
Figure 3:
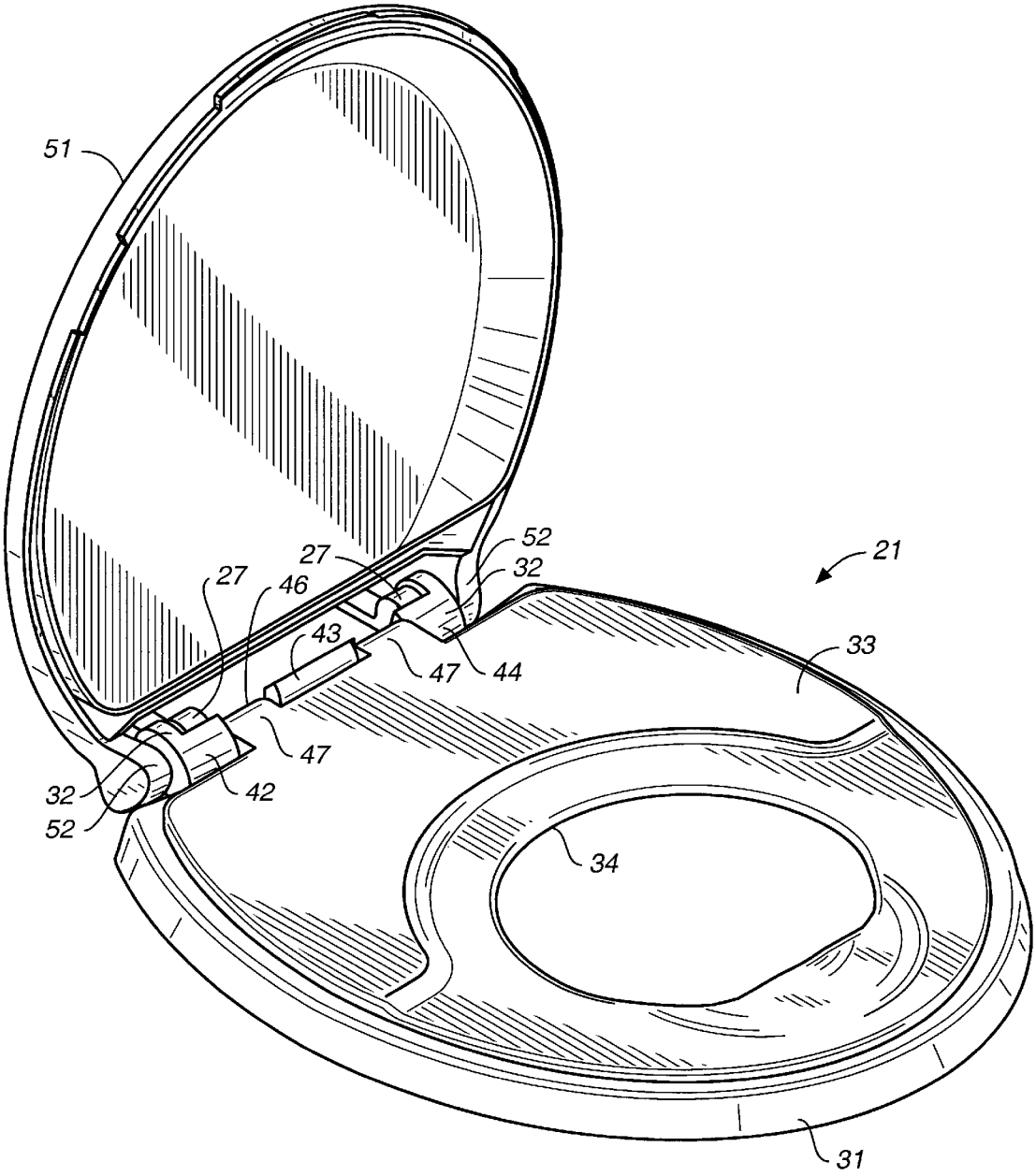
FIG. 3 is a top perspective view, corresponding to FIG. 2, with the child's toilet seat in the near horizontal, deployed or lowered position.
Figure 4:
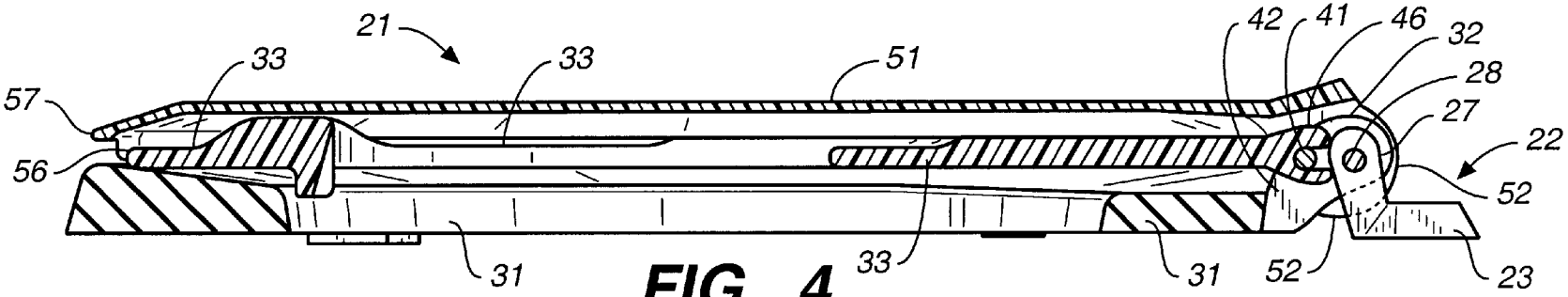
FIG. 4 is an enlarged, cross sectional view, taken substantially along the plane of line 4—4 in FIG. 1.
Figure 6:
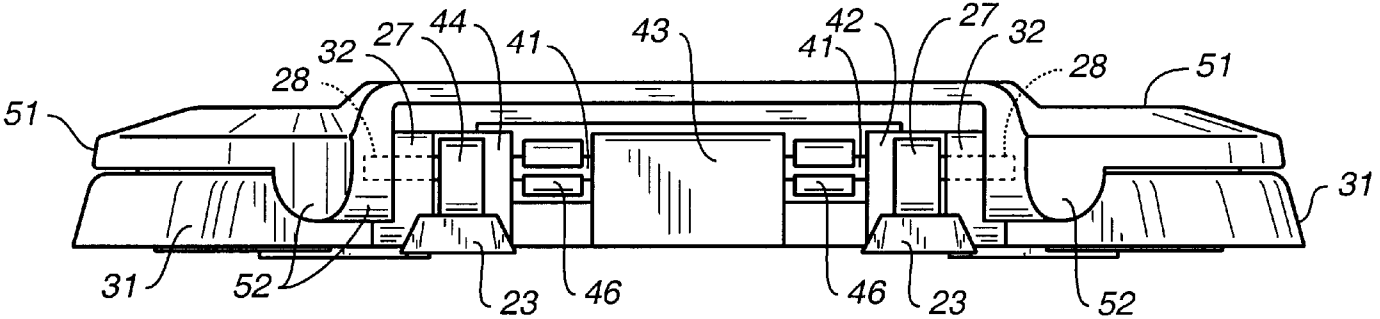
FIG. 6 is a rear elevation view of the seat assembly of the present invention with all components in the lowered or near horizontal position.

Referring now to FIGS. 1–4, the various components of the combined adult and children's toilet seat assembly, generally designated 21, can be set forth. A seat mounting structure, generally designated 22, may be seen in FIG. 4. Mounting structure 22 advantageously may take the form of a pair of L-shaped brackets 23 that can be mounted to toilet bowl 26 using conventional bolt fasteners 24. Bracket members 23 may include a bolt head-receiving cavity for mounting of seat assembly 21 to toilet bowl 26. An upstanding leg 27 of bracket 23 preferably is provided with a transversely extending pivot pin or rod 28, best seen in FIG. 6. The remainder of seat assembly 21 is pivoted to pivot rods 28 for pivotal movement about a horizontally extending, first axis through the center of rods 28. Assembly 21, therefore, is pivotal between a near horizontal position of the components, as shown in FIGS. 1 and 4 and a near vertical, but rearwardly tilted and stable position, for example, as is shown for the lid and child's seat in FIG. 5.

Seat assembly 21 further includes an adult toilet seat 31, a child's toilet seat 33 and a toilet seat lid 51. Lid 51 is preferably pivotally mounted directly to mounting structure 22 by mounting to pivot rods 28. Thus, bosses 52 provided on the opposite sides of a lowered edge of lid 51 include bores which receive pivot rods 28. The lid can be pivoted, therefore, between a near horizontal position, covering the child's and adult seats, and a near vertical, but slightly rearwardly tilted, raised position, as shown in FIG. 5, and as is well known in the art.

Obviously, as the rearward tilt of lid 51 is increased, it becomes more stable in its raised position, but some toilet tank and/or wall configurations do not permit substantial rearward tilting of lid 51, and such a solution is not always aesthetically pleasing.

An important aspect of any combined adult and child's toilet seat assembly is that the child's seat, seat 33, must also be capable of being raised and stored in a stable raised condition, for example, when the adult seat is in use. As the angle of rearward tilting of lid 51 decreases, so that the lid is almost vertical, prior art structures have caused the stability of the child's seat also to decrease, because of its position in front of the lid.

Figure 5:
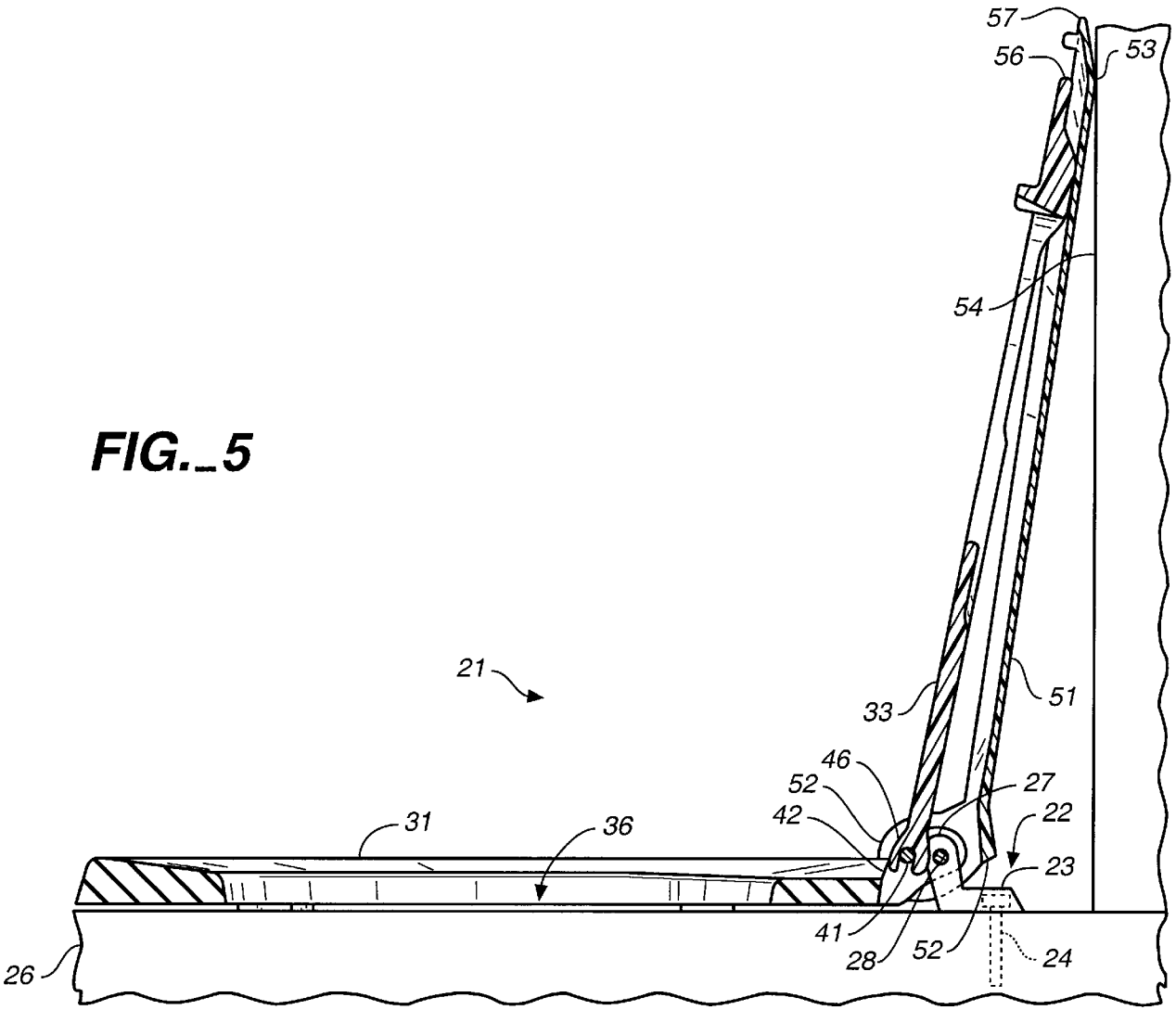
FIG. 5 is a cross sectional view, corresponding to FIG. 4, showing the seat assembly mounted to a toilet bowl with the lid and child's toilet seat in the raised, rearwardly tilted position.

Mounting of the child's seat 33 in the present assembly 21, however, is accomplished in a manner which ensures stability of the child's seat when it is in the raised, near vertical position of FIGS. 2 and 5. Rather than simply mounting the child's seat 33 to pivot pin 28 of mounting structure 22, child's seat 33 is mounted to a second axis of rotation which is positioned forwardly of the first axis provided by pivot rods 28. As best may be seen in FIGS. 4 and 5, a second set of pivot pins or rods 41 is carried by upstanding flanges 42, 43 and 44 which are integrally, and preferably monolithically, formed with adult toilet seat 31. As best may be seen in FIG. 2, adult toilet seat 31 may include three upstanding flanges 42, 43 and 44 along its rearward edge. Flanges 42 and 44, proximate the outer edges of adult toilet seat 31, have extension portions 32 with bores through which mounting structure pivot pins 28 extend. Extension portions 32 on outer flanges 42 and 44, therefore, mount adult seat 31 to mounting structure 22, while flanges 42, 43 and 44 also carry a pair of pivot pins 41 which mount children's toilet seat 33 for pivotal movement to the adult seat. The ends of wishbone or U-shaped gripper structures 46 resiliently grip a pivot pin 41 in a notch defined between flanges 42 and 43 and another pivot pin 41 in a notch between flanges 43 and 44. Grippers 46 are carried on arms 47 integrally formed at the inner edge of child's toilet seat 33.

Comparing the FIGS. 4 and 5, the advantage provided by the relative placement of pins 28 and 41 can be appreciated. In the horizontal or deployed position of FIG. 4, all of the components are nested in a vertically compact and substantially parallel relationship. Thus, adult seat 31, child seat 33 and lid 51 are all pivoted in a manner which causes them to be parallel and over the toilet bowl in the desired orientation. In FIG. 5, lid 51 has been pivoted upwardly to a near vertical but rearwardly tilted, stable raised position. Often this position will result in the upper end 53 of lid 51 resting against a tank 54 of the toilet assembly or a wall. It will be understood that lid 51 may simply be restrained against further rearward tilting by engagement of the rotatable bosses 52 with a stop (not shown), and lid 51 need not engage a toilet tank 54 or wall.

Child's seat 33 is also seen in FIG. 5 as being in a near vertical, but rearwardly tilted, raised position. The location of pivot rods 41 in advance or forwardly relative to pivot rods 28 for the lid results in the child's seat 33 tilting rearwardly at an angle which is greater than the angle of tilt for lid 51. This greater rearward tilt gravity biases the child's seat to even a greater degree in a rearward direction than is the case for lid 51. The forward position of the transverse pivot rods 41, therefore, enhances the stability of the child's seat in the lifted position and tends to cause it to nest within the lid in a stable manner. This ensures that the child's toilet seat does not drop down to the horizontal position if, for example, the seat assembly is bumped during use by an adult.

In the embodiment shown, transverse pivot rods 41 are carried by flanges 42, 43 and 44 that are integrally formed with adult seat 31. It will understood, however, that a second pivot axis 41 could be provided by extending the L-shaped mounting brackets 23 forwardly at their upper ends and providing a transverse pivot rod at such a forward position. In either event, the two pivot axes provide for great stability of the children's seat within the lid in the raised position, without the use of detents, retainer clips, brackets or the like.

As can be seen in FIG. 5, upper end 56 of child's seat 33 is downwardly displaced relative to upper end of 57 of lid 51 when the two are in the lifted position. When adult seat 31 is pivoted to the near vertical position (not shown), it will produce pivoting of transverse pivot rods 41 about transverse pivot rods 28 of seat mounting structure 22. This in turn causes pivot rods 41 to be swung to a position above pivot rods 28, and the end 56 of child's seat 33 is upwardly displaced to a position which corresponds to the relative position of ends 56 and 57 in FIG. 4.

An additional important feature of the present invention is that the child's seat is easily removed from the seat assembly without the use of tools. Resiliently expandable, U-shaped grippers 46, provided at arms 47 on children's toilet seat 33, allow the child's toilet seat to be easily removed from assembly 21 without the need for unbolting the assembly from the toilet bowl. Thus, when children get older and the child's toilet seat is no longer necessary, or for applications in which younger children are only occasionally visiting, child seat 33 may be easily removed by the homeowner by pulling the seat outwardly. This expands grippers 46 and they will pass over rods 41 to release the seat. Such resilient grippers are broadly shown in U.S. Pat. No. 2,221,991, but not in combination with a pivotal mount which enhances child seat stability in the upward position nor in an assembly in which the lid, child seat and adult seat have the compact height profile of the seat assembly 21 of the present invention.

A further feature of the present invention can best be seen by reference to FIG. 2. The combination of upwardly extending flanges 42, 43 and 44 on adult seat 31, as well as the downwardly depending gripper arms 46 on child's seat 33, provide a barrier along the back edge of adult seat 41 when the child's seat is in the lifted position. This barrier tends to resist liquid passage beyond the back edge of the adult toilet seat. This structure also makes it relatively easy to wipe the assembly clean.

As can be seen by comparing FIGS. 2 and 3, opening 34 in child's toilet seat 33 is significantly smaller than opening 36 in adult toilet seat 31. Thus, when the child's toilet seat is in the deployed, near horizontal orientation, smaller opening 34 is superimposed over larger seat opening 36 so as to provide the child with a seat which is more suited to his or her stature. Such a structure, of course, is common to, and the purpose of, prior art combined adult and children's toilet seat assemblies.

In the most preferred embodiment, all the components are injection molded of a plastic material. Moreover, this allows elements such as flanges 42, 43 and 44 to be monolithically formed with adult seat 31, while resiliently expandable gripper arms 47 and gripping ends 46 can be monolithically formed with child seat 33. The preferred injection molding plastic is polypropyline.

What is claimed is:

1. A combined adult and children's toilet seat assembly comprising:

a seat mounting structure formed for mounting to a toilet bowl;

an adult seat assembly mounted to said mounting structure and including a toilet seat lid pivotally mounted to said adult seat assembly for pivoting of said lid about a first axis between a near horizontal position over the bowl and a rearwardly tilted, stable, near vertical position, said seat assembly also including a transverse pivot rod integrally formed therewith; and a children's toilet seat removably and pivotally mounted about a second axis formed by said pivot rod forwardly of said first axis for movement of said children's toilet seat between a near horizontal position and a near vertical position tilted rearwardly into said seat lid by an amount greater than the rearward tilt of said seat lid.

2. The combined adult and children's toilet seat assembly as defined in claim 1 wherein, said adult seat assembly includes an adult toilet seat and said seat lid and said adult toilet seat are both pivotally mounted to said mounting structure for pivotal movement about said first axis.

3. The combined adult and children's toilet seat assembly as defined in claim 2 wherein, said children's toilet seat is releasably mounted for pivotal movement about said second axis carried by said adult toilet seat for removal of said children's toilet seat from said adult seat assembly without removal of said adult toilet seat.

4. The combined adult and children's toilet seat assembly as defined in claim 3 wherein, said children's toilet seat is releasably mounted to said adult toilet seat by said transverse pivot rod mounted proximate a rear edge of said adult toilet seat and at least one resiliently expandable gripper structure.

5. The combined adult and children's toilet seat assembly as defined in claim 4 wherein, said gripper structure is provided on said children's toilet seat.

6. The combined adult and children's toilet seat assembly as defined in claim 2 wherein, said adult toilet seat and said children's toilet seat are cooperatively formed to provide a barrier to the passage of liquid rearwardly of said adult toilet seat to said mounting structure when said adult seat is in said near horizontal position and said child seat and said seat lid are in said near vertical position.

7. A combined adult and children's toilet seat assembly a seat mounting structure formed for mounting to a toilet bowl;

a seat assembly mounted to said mounting structure and including an adult toilet seat, a toilet seat lid, and pivot rods provided on said adult toilet seat proximate a rear edge of said adult toilet seat and forming a second axis, said adult toilet seat and said toilet seat lid pivotally mounted to said mounting structure for pivotal movement about a first axis between a near horizontal position over the bowl and a rearwardly tilted, stable, near vertical position; and a children's toilet seat pivotally mounted about said second axis forwardly of said first axis for movement of said children's toilet seat between a near horizontal position and a near vertical position tilted rearwardly into said seat lid by an amount greater than the rearward tilt of said seat lid, said children's toilet seat being releasably mounted about said second axis carried by said adult toilet seat for removal of said children's toilet seat from said seat assembly without removal of said adult toilet seat wherein, said adult seat includes a plurality of upwardly extending laterally spaced apart flanges at a rear edge of said adult seat and said pivot rods extend between said spaced apart flanges, and said children's seat includes a pair of resiliently expandable grippers dimensioned to closely fit between said spaced apart flanges and to rotatably grip said pivot rods, said grippers extending beyond said pivot rods into close proximity with said adult seat.

8. The combination adult and children's toilet seat assembly as defined in claim 2 wherein, said mounting structure is provided by a pair of spaced apart brackets; and said seat lid, said adult toilet seat and said children's toilet seat are all formed from plastic.

9. The combination adult and children's toilet seat assembly as defined in claim 2 wherein, said second axis is provided on said adult toilet seat in a position causing said second axis to become vertically aligned with said first axis when said adult toilet seat is pivoted to said near vertical position.

10. The combined adult and children's toilet seat assembly as defined in claim 7 wherein, said adult toilet seat and said children's toilet seat are cooperatively formed to provide a barrier to the passage of liquid rearwardly of said adult toilet seat to said mounting structure when said adult seat is in said near horizontal position and said child seat and said seat lid are in said near vertical position.

11. The combined adult and children's toilet seat assembly as defined in claim 7 wherein, said mounting structure is provided by a pair of spaced apart brackets; and said seat lid, said adult toilet seat and said children's toilet seat are all formed from plastic.

12. The combined adult and children's toilet seat assembly as defined in claim 7 wherein, said second axis is provided on said adult toilet seat in a position causing said second axis to become vertically aligned with said first axis when said adult toilet seat is pivoted to said near vertical position.

13. A combined adult and children's toilet seat assembly comprising:

a seat mounting structure formed for mounting to a toilet bowl;

a seat assembly mounted to said mounting structure and including a toilet seat lid and an adult toilet seat having a flange monolithically formed with said adult toilet seat, said toilet seat lid and said adult toilet seat pivotally mounted about a first axis between a near horizontal position over the bowl and a rearwardly tilted, stable, near vertical position, said seat assembly also including a transverse pivot rod extending from said flange and forming a second axis forwardly of said first axis; and a children's toilet seat pivotally mounted about said second axis for movement of said children's toilet seat between a near horizontal position and a near vertical position tilted rearwardly into said seat lid by an amount greater than the rearward tilt of said seat lid.

14. The combined adult and children's toilet seat assembly as defined in claim 13 wherein, said children's toilet seat is releasably mounted for pivotal movement about said second axis for removal of said children's toilet seat from said seat assembly without removal of said adult toilet seat.

15. The combined adult and children's toilet seat assembly as defined in claim 13 wherein, said children's toilet seat is releasably mounted to said adult toilet seat by said transverse pivot rod mounted proximate a rear edge of said adult toilet seat and a resiliently expandable gripper structure provided on said children's toilet seat.

16. The combined adult and children's toilet seat assembly as defined in claim 13 wherein, said adult toilet seat and said children's toilet seat are cooperatively formed to provide a barrier to the passage of liquid rearwardly of said adult toilet seat to said mounting structure when said adult seat is in said near horizontal position and said child seat and said seat lid are in said near vertical position.

17. The combined adult and children's toilet seat assembly as defined in claim 13 wherein, said mounting structure is provided by a pair of spaced apart brackets.

18. The combined adult and children's toilet seat assembly as defined in claim 13 wherein, said seat lid, said adult toilet seat and said children's toilet seat are all formed from plastic.

19. The combined adult and children's toilet seat assembly as defined in claim 13 wherein, said second axis is provided on said adult toilet seat in a position causing said second axis to become vertically aligned with said first axis when said adult toilet seat is pivoted to said near vertical position.

* * * * *